US009309748B2

(12) United States Patent
Gadot et al.

(10) Patent No.: US 9,309,748 B2
(45) Date of Patent: Apr. 12, 2016

(54) POWER GENERATION VIA DRILLSTRING PIPE RECIPROCATION

(71) Applicant: Schlumberger Technology Corporation, Sugar Land, TX (US)

(72) Inventors: Raphael Gadot, Houston, TX (US); Jan Morley, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 426 days.

(21) Appl. No.: 13/721,840

(22) Filed: Dec. 20, 2012

(65) Prior Publication Data

US 2014/0174733 A1 Jun. 26, 2014

(51) Int. Cl.

| | |
|---|---|
| ***E21B 41/00*** | (2006.01) |
| ***E21B 47/00*** | (2012.01) |
| ***E21B 47/09*** | (2012.01) |
| ***E21B 47/12*** | (2012.01) |

(52) U.S. Cl.

CPC ..... *E21B 41/0085* (2013.01); *E21B 47/0006* (2013.01); *E21B 47/09* (2013.01); *E21B 47/12* (2013.01)

(58) Field of Classification Search

USPC ..... 166/264, 382, 65.1, 381, 383

See application file for complete search history.

(56) References Cited

U.S. PATENT DOCUMENTS

| | | | | |
|---|---|---|---|---|
| 3,435,906 | A * | 4/1969 | Nicolson | E21B 7/128 175/103 |
| 5,799,733 | A | 9/1998 | Ringgenberg et al. | |
| 2004/0265122 | A1* | 12/2004 | Bresolin et al. | 415/203 |
| 2006/0175838 | A1* | 8/2006 | Tips | 290/1 R |
| 2006/0254819 | A1* | 11/2006 | Moriarty | 175/40 |
| 2010/0236777 | A1* | 9/2010 | Partouche et al. | 166/254.2 |
| 2010/0238763 | A1* | 9/2010 | Gzara | G01V 1/44 367/25 |
| 2010/0282515 | A1* | 11/2010 | Reid et al. | 175/58 |
| 2010/0300677 | A1 | 12/2010 | Patterson, III et al. | |

* cited by examiner

*Primary Examiner* — Taras P Bemko

(74) *Attorney, Agent, or Firm* — David G. Matthews; Cathy A. Hewitt; Trevor Grove

(57) ABSTRACT

A wireline configurable toolstring is conveyed within a wellbore extending into a subterranean formation via a tubular string to which the wireline configurable tool string is coupled in a manner permitting relative motion of the wireline configurable toolstring and the tubular string. The wireline configurable toolstring converts rotary motion imparted by rotation of the tubular string, or by fluid flow resulting from reciprocation of the tubular string, into electrical energy. The wireline configurable toolstring also comprises at least one wireline configurable instrument powered by the electrical energy.

11 Claims, 7 Drawing Sheets

POWER GENERATION VIA DRILLSTRING PIPE RECIPROCATION

BACKGROUND OF THE DISCLOSURE

Well logging instruments are devices configured to move through a wellbore extending into one or more subterranean formations. Such instruments include sensors and other devices that measure properties of the formations and/or perform certain mechanical acts on the formations, such as obtaining liquid, gaseous and/or solid samples of the formations. Many well logging instruments are wireline configurable and are thus conveyed within the wellbore via armored electrical cable known as "wireline". Such conveyance relies on gravity to move the instruments within the wellbore. However, some wellbores include one or more lateral or other non-vertical sections, such that conveyance via wireline may be impractical due to friction between the wellbore wall and the wireline and/or the instruments coupled to the wireline. Consequently, a drillstring or similar string of threadedly coupled pipe segments may instead be utilized to convey the wireline configurable instruments. However, because the wireline configurable instruments are not connected by a wireline to an electrical power source at surface, the wireline configurable instruments cannot be powered by wireline.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
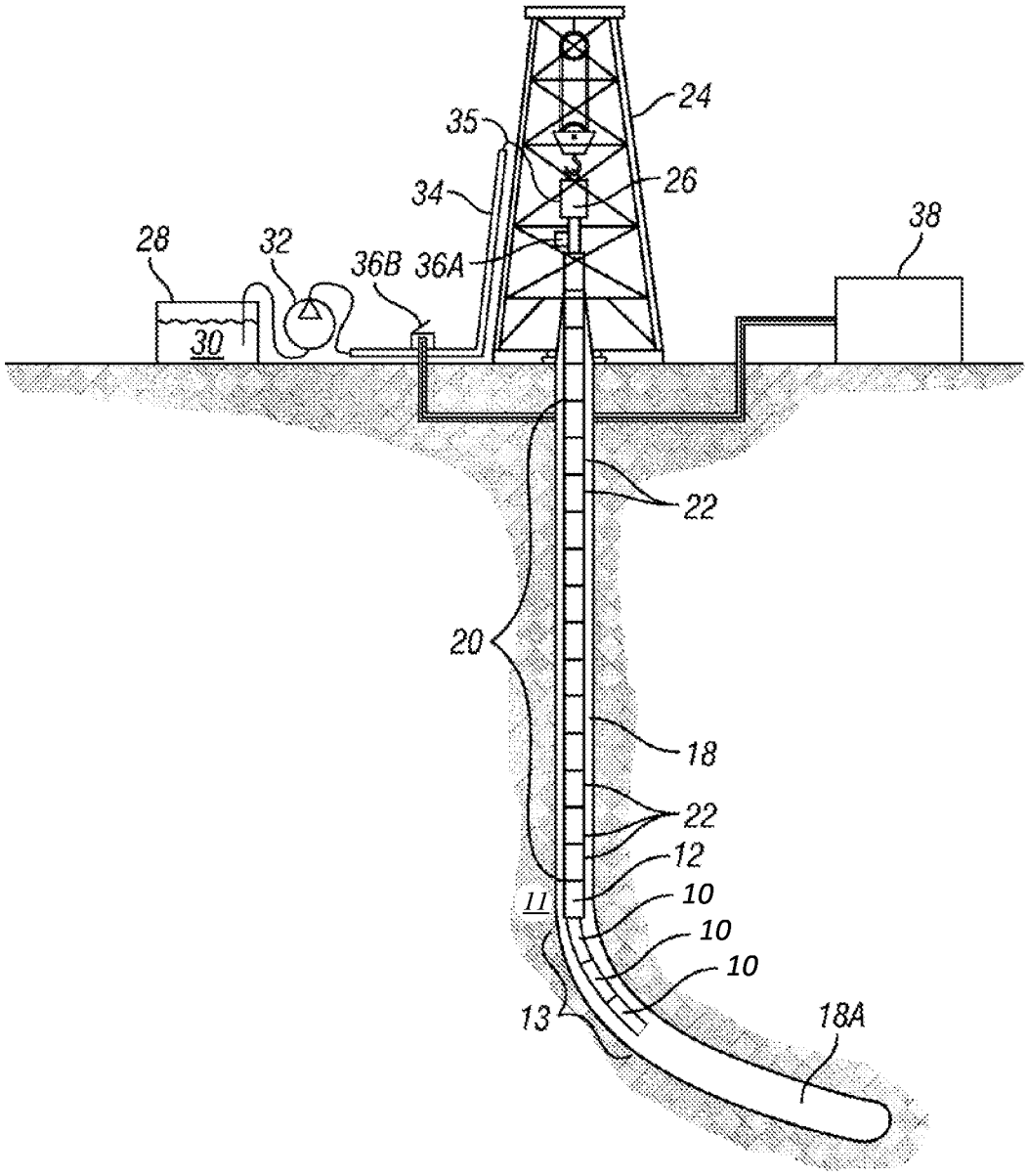
FIG. 1 is a schematic view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

In FIG. 1, a drilling rig 24 or similar lifting device moves a tubular string 20 within a wellbore 18 that has been drilled into a subterranean formation 11. The tubular string 20 comprises a string of threadedly coupled segments or joints 22 of drill pipe, wired drill pipe and/or other substantially rigid tubulars. Wired drill pipe is structurally similar to ordinary drill pipe but includes a signal communication channel extending along the length of each pipe segment, such as a cable or an optical fiber. The signal communication channel may comprise a conduit extending partially or substantially within the interior of each joint. At each end of the joint, a signal-coupling device may be utilized to communicate signals along the channel between joints when the joints are coupled end-to-end as shown in FIG. 1.

A wireline configurable toolstring 13 is coupled at or near a lower end of the tubular string 20. The wireline configurable toolstring 13 comprises a string of well logging instruments 10 threadedly or otherwise coupled end-to-end, wherein at least one of the instruments 10 is wireline configurable. In the context of the present disclosure, wireline configurable instruments are well logging instruments that are usually conveyed within the wellbore via wireline, and which usually cannot be used in a drillstring for conducting drilling operations. Wireline configurable instruments are thus distinguishable from LWD instruments. That is, LWD instruments are specifically configured to be utilized during drilling operations, and can therefore form part of the drillstring itself.

The wireline configurable toolstring 13 may comprise one or more wireline configurable instruments 10 for measuring one or more characteristics of the formation 11. Such characteristics may include electrical properties, sonic properties, nuclear properties (active and passive), and/or physical properties of the formation 11 such as pressure, temperature and porosity, among others. The wireline configurable toolstring 13 may also or alternatively comprise one or more wireline configurable instruments 10 for obtaining a fluid or solid sample from the formation 11. The wireline configurable toolstring 13 may also or alternatively comprise one or more wireline configurable instruments 10 for obtaining one or more dimensional properties of the wellbore, such as diameter and/or eccentricity.

The tubular string 20 may be a drillstring utilized to turn and axially urge a drill bit into the bottom of the wellbore 18 to increase its length (depth). During such drilling, a pump 32 lifts drilling fluid (also known as drilling mud) 30 from a tank or pit 28 and discharges the drilling fluid 30 under pressure through a standpipe 34 and flexible conduit or hose 35, through a top drive 26, and into an interior passage of the drillstring 20. The drilling fluid 30 exits the drillstring 20 through the drill bit, where it then cools and lubricates the drill bit and lifts cuttings generated by the drill bit to surface.

When the wellbore 18 has been drilled to a selected depth, the tubular string 20 may be withdrawn from the wellbore 18, and the wireline configurable toolstring 13 may be coupled at or near the end of the tubular string 20. An adapter/power generator sub 12 ("power sub" for convenience hereinafter)

may also be coupled to the tubular string 20 and/or the wireline configurable toolstring 13. The power sub 12 may provide electrical power and a communication interface to the drilling rig 24 and/or the wireline configurable toolstring 13. Alternatively, the power sub 12 may comprise two separate subs or pipe joints, with one providing electrical power to the wireline configurable toolstring 13, and the other providing an interface for communication with the drilling rig 24 and/or the wireline configurable toolstring 13. Those having ordinary skill in the art will understand that the scope of the present disclosure is not limited to any certain embodiment of the power sub 12, and that variations may be utilized depending on the structure of the tubular string 20, the drilling rig 24, the wireline configurable toolstring 13 and/or the formation 11. Variations excluding the power sub 12 are also within the scope of the present disclosure.

After coupling the wireline configurable toolstring 13 to the tubular string 20 at surface, the tubular string 20 may be reinserted into the wellbore 18 so that the wireline configurable toolstring 13 may be conveyed within the wellbore 18. Positioning the wireline configurable toolstring 13 on the tubular string 20 may permit the above-described formation/wellbore measurements within highly inclined or deviated portions 18A of the wellbore 18, which would be inaccessible or at least difficult using wireline to convey the wireline configurable toolstring 13 within the wellbore 18.

As the wireline configurable toolstring 13 is conveyed along the wellbore 18 by moving the tubular string 20 as explained above, signals detected by one or more instruments 10 of the wireline configurable toolstring 13 are selected to be directed to a telemetry transceiver in the power sub 12 for communication to surface equipment. For example, where the tubular string 20 comprises wired drill pipe, such signal transmission may be along the signal channel in the wired drill pipe. However, mud-pulse telemetry and/or other types of telemetry may also or alternatively be utilized.

A telemetry transmitter 36A at surface may be utilized to wirelessly transmit signals from the wireline configurable toolstring 13 (whether received via mud-pulse telemetry, the communication channel of wired drill pipe, or otherwise) to a surface receiver 36B. Accordingly, the tubular string 20 may be freely moved, assembled, disassembled and rotated without making or breaking a wired or optical signal connection. Electrical and/or optical signals from the receiver 36B may be conducted (such as by wire or cable) to a surface recorder 38 for decoding and/or interpretation by conventional or future-developed techniques. The decoded signals correspond to the measurements made by one or more sensors of one or more of the wireline configurable instruments 10 of the wireline configurable toolstring 13. The one or more sensors may comprise one or more density sensors, pressure sensors, temperature sensors, neutron porosity sensors, acoustic travel time or velocity sensors, seismic sensors, neutron induced gamma spectroscopy sensors and microresistivity (imaging) sensors, among others. It should be understood that the transmitter 36A and receiver 36B may be transceivers such that signal communication may also be provided from the surface recorder 38 to the wireline configurable toolstring 13 and/or a wireline configurable instrument 10 thereof.

During well logging operations, the pump 32 may be operated to provide fluid flow to operate one or more turbines or impellers (not shown in FIG. 1) in the wireline configurable toolstring 13 and/or the power sub 12 to provide electrical power to operate one or more wireline configurable instruments 10 in the wireline configurable toolstring 13. Other methods of providing electrical power may additionally or alternatively be utilized within the implementation illustrated in FIG. 1. For example, the power sub 12, another portion of the tubular string 20, and/or the wireline configurable toolstring 13 may comprise batteries to provide electrical power to operate one or more electrically powered instruments 10 in the wireline configurable toolstring 13. The batteries may be rechargeable by the flow of drilling fluid 30 across a mud turbine coupled to a generator or alternator of the wireline configurable toolstring 13, and may provide electrical power to the wireline configurable toolstring 13 when the mud turbine is not in operation. The batteries may also provide supplemental electrical power during operation of the mud turbine.

The power sub 12 may provide a mechanical coupling between the tubular string 20 and an uppermost connection of the wireline configurable toolstring 13. The power sub 12 may also comprise signal processing and recording devices (explained below with reference to FIG. 4) for selecting particular signals from the wireline configurable toolstring 13 for transmission to surface, and recording signals in a suitable storage or recording device in the power sub 12. The power sub 12 may also comprise processing and/or computing capabilities to prioritize and/or interpret certain data before transmission to surface. Signals transmitted from surface may also be communicated to the wireline configurable toolstring 13 via the power sub 12.

The implementation illustrated in FIG. 1 comprises a top drive to impart rotary motion to the tubular string 20. However, other implementations within the scope of the present disclosure may alternatively or additionally utilize a swivel, kelly, kelly bushing and rotary table (not shown in FIG. 1) for rotating the tubular string 20 while providing a pressure sealed passage through the tubular string 20 for mud 30.

Figure 2:
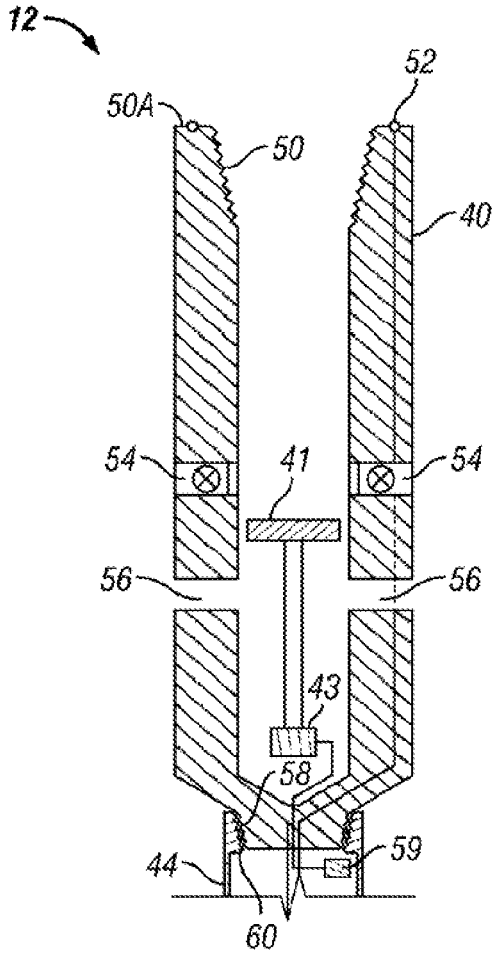
FIG. 2 is a schematic view of apparatus according to one or more aspects of the present disclosure.

FIG. 2 is a schematic cross-sectional view of the power sub 12 shown in FIG. 1 in which the tubular string 20 comprises wired drill pipe. Referring to FIG. 2, but with continued reference to FIG. 1, the power sub 12 may comprise one or more sources of electrical power to operate the wireline configurable toolstring 13 shown in FIG. 1. One such source may comprise a converter that converts the flow of drilling fluid 30 into electric power. For example, the power sub 12 may comprise an impeller 41 that is rotated by the flow of drilling fluid moved by the surface pump 32. The impeller 41 may be disposed in a housing 40 that may comprise threaded connections 50 to couple to the lowermost threaded connection of the tubular string 20. An electric alternator 43 disposed in the housing 40 may be rotationally coupled to the impeller 41. The alternator 43 may alternatively be a generator. Use of the terms "generator" and "alternator" herein may be interchangeable in that use of either direct current electric generators or alternating current generators is within the scope of the present disclosure, and the term "alternator" as used herein, including in the claims, may include both types of devices within its scope. Electrical output from the alternator 43 may be conditioned to operate various components in the wireline configurable toolstring 13 and/or in a power conditioner module 59. The power conditioner module 59 may comprise batteries or other electric power storage devices (not shown separately) to provide power during times when the impeller 41 is not operating, such as during connections at surface, when a joint or stand of pipe is added to or removed from the tubular string 20. The power conditioner module 59 may be disposed in the housing 40, the wireline configurable toolstring 13, or another location in the tubular string 20.

The impeller 41 may exhibit a controllable response to fluid flow, such as by controllable blade pitch, a controllable brake (not shown) and/or controllable bypass ports 54. Other methods may include a controllable distance between the rotor and stator, where the controllable distance may be actively or passively controlled based on the thrust force of the flow/rotational speed. The controllable response may also be by a variable distance between the tips of the blades of the impeller 41 and the housing 40, such as by moving either the impeller 41 or the housing 40 axially relative to the other. Again, this could be performed passively based on the thrust force, the rotational speed or combination of the two, or it could be controlled actively. Such methods may effectively alter the efficiency of the impeller 41. The controllable response feature of the impeller 41 may provide improved operation of the alternator 43 under widely variable electrical load conditions.

The upper threaded connection 50 may comprise a communication device 52 disposed in a thread shoulder 50A of the upper threaded connection 50. The communication device 52 may be electromagnetic, although others are also within the scope of the present disclosure.

As mentioned above, the housing 40 may comprise one or more controllable bypass valves 54. The controllable bypass valves 54 may be operated, for example, by solenoids (not shown) to selectively enable part of the fluid flow through the tubular string 20 to be diverted into the wellbore 18 above the impeller 41, thus reducing the output of the impeller 41. The housing 40 may alternatively or additionally comprise fixed discharge ports 56 below the impeller 41 to enable the flow of fluid that operates the impeller 41. The housing 40 may comprise a lower threaded connection 58 that is configured to couple to an upper threaded connection 60 in the head 44 of the wireline configurable toolstring 13.

In some instances, the measurement and/or sampling procedure performed in the wellbore 18 may require the wireline configurable toolstring 13 to be stationary relative to the wellbore 18, but the tubular string 20 may not be stationary at surface. For example, the drilling rig 24 may be a floating drilling rig constructed on a floating platform, which may have ineffective heave compensation devices, or which may be operating under in heavy wave conditions. Thus, the wireline configurable toolstring 13 and/or the power sub 12 may comprise an axial slip joint to account for the changing distance between the drilling rig 24 and the seabed. Such an axial slip joint may also be utilized to compensate for thermal expansion of the tubular string 20 attributable to temperature changes, whether the drilling rig 24 is a land-based rig or a floating rig.

Figure 3:
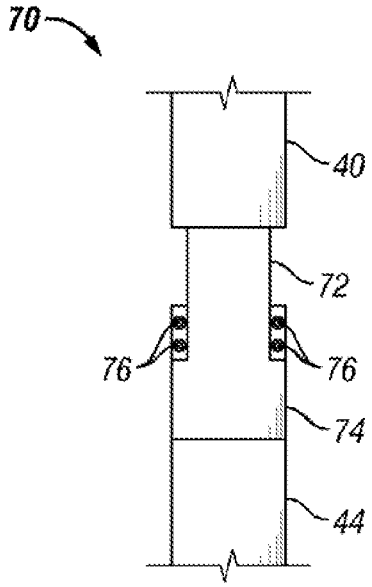
FIG. 3 is a schematic view of apparatus according to one or more aspects of the present disclosure.

FIG. 3 is a schematic view of an example of one such slip joint, herein designated by reference numeral 70. Referring to FIG. 3 with continued reference to FIGS. 1 and 2, the slip joint 70 may comprise an upper housing 72 and a lower housing 74. The upper housing 72 may be engaged with the housing 40 of the power sub 12, and the lower housing 74 may be engaged with a lower component of the power sub 12 (e.g., the power conditioner module 59) or the head 44 of the wireline configurable toolstring 13. The upper and lower housings 72 and 74 may be integrally formed, or they may be separate, distinct components that are slidably engaged or otherwise connected in a manner permitting axial movement of one relative to the other. The slip joint 70 may also comprise one or more O-rings 76 and/or similar sealing devices that enable relative axial movement between the upper and lower housings 72 and 74 while maintaining a seal therebetween.

The wireline configurable instruments 10 may generate signal data at large multiples of the maximum bandwidth of wired drill pipe or mud-pulse telemetry. Accordingly, the available wired drill pipe or mud-pulse telemetry bandwidth may be utilized to communicate to surface those signals from the wireline configurable toolstring 13 that are more valuable to obtain substantially in real-time (i.e., as they are measured). With other types of data, such as data obtained for instrument diagnostics, it may be less important to obtain the data in real time, and such data may be stored in a local data storage device downhole. It should be appreciated that, in this context, the type of data that is more valuable or less valuable may change depending upon the measurement and/or sampling procedure being performed downhole, performance of the wireline configurable instruments 10, and/or the downhole conditions. For example, diagnostic data for one of the wireline configurable instruments 10 may be more valuable that other types of data if the instrument is failing or about to fail. It may also be desirable to be able to change the particular signals transmitted to surface in real time, and/or to change the sample rate of such real time transmission. For example, induction resistivity corresponding to large lateral distance from the wellbore 18, among other measurements, may change relatively slowly as the axial position of the wireline configurable toolstring 13 within the wellbore 18 changes. Such measurements may be sent to surface at relatively slow rates (e.g., 1-100 Hz). Microresistivity measurements for wellbore imaging and/or other measurements may change more rapidly as the axial position of the wireline configurable toolstring 13 within the wellbore 18 changes, and may thus be transmitted at higher rates (e.g., 1 KHz to 1000 KHz).

It may also be desirable to change which signals are transmitted to surface in real time (whether via wired drill pipe or otherwise) when certain conditions exist in the wireline configurable toolstring 13. Although not illustrated in the figures, one or more sensors of one or more of the wireline configurable instruments 10 may measure operating parameters that relate to functioning of the wireline configurable instruments 10. Such sensors may include a voltage sensor to measure voltage applied to the wireline configurable instrument 10 and/or the wireline configurable toolstring 13, a current sensor to measure current drawn by the wireline configurable instrument 10 and/or the wireline configurable toolstring 13, and/or a temperature sensor to measure an internal temperature of the wireline configurable instrument 10 and/or the wireline configurable toolstring 13, among other sensors within the scope of the present disclosure. Such measurements may be stored in a data storage device of the wireline configurable toolstring 13 and/or in the power sub 12. However, such measurements may be stored as such where the values of the measurements are within a predetermined operating range but not outside the range, and in the event any of the operating parameters falls outside their respective predetermined range, the telemetry function of the power sub 12 and/or the wireline configurable toolstring 13 may be configured to transmit the out of range measurements to surface in real time, such as may inform an automated or human system operator of the adverse condition. For example, instrument operating parameter measurements falling outside a predetermined range may be automatically transmitted to surface. Moreover, previously recorded measurements may subsequently be requested from surface, whether automatically or as desired by the automated or human system operator.

Figure 4:
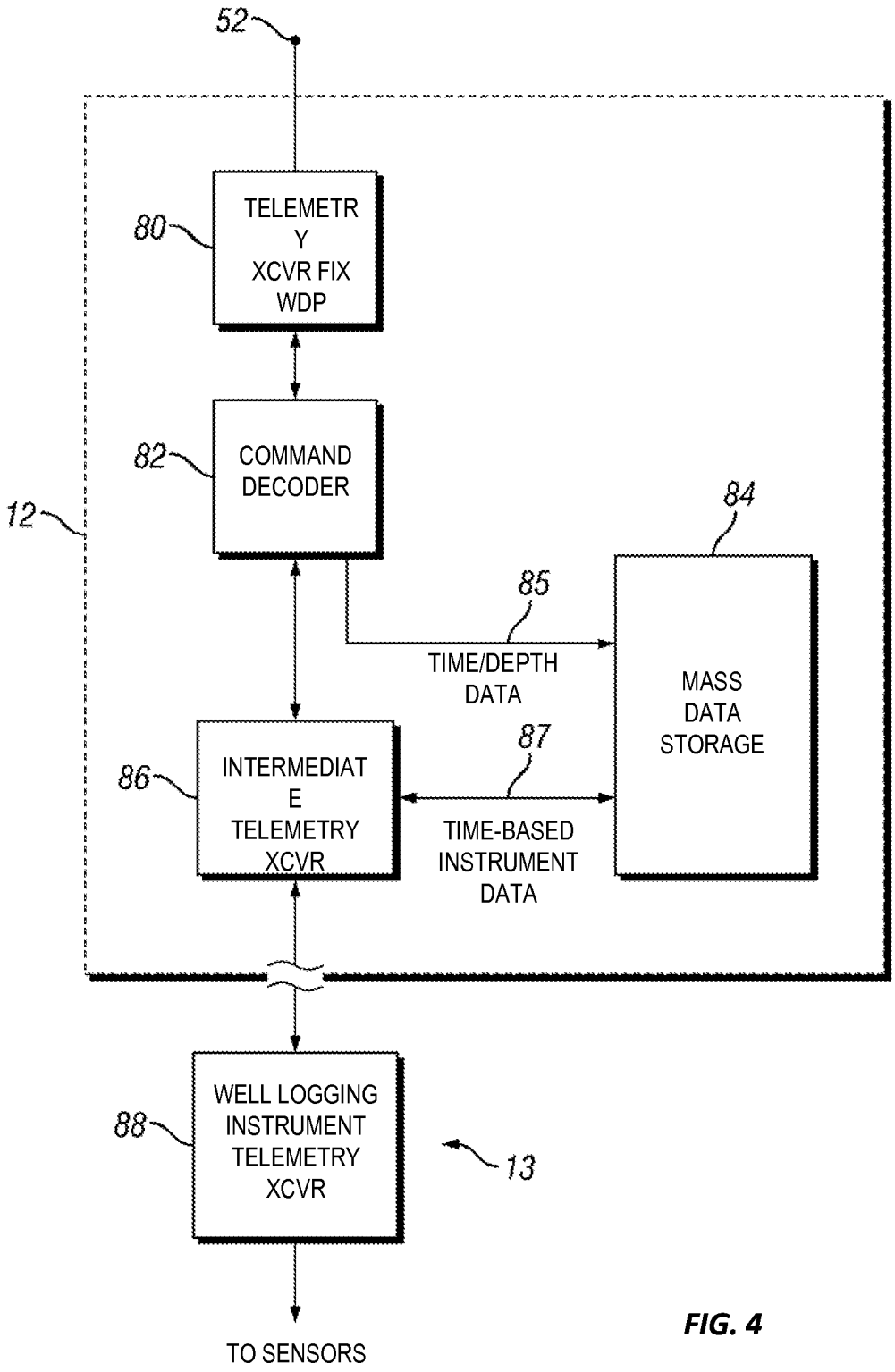
FIG. 4 is a schematic view of apparatus according to one or more aspects of the present disclosure.

FIG. 4 is a schematic view of an example signal processing and recording unit that can perform the foregoing telemetry conversion and formatting according to one or more aspects of the present disclosure, for an implementation in which the tubular string 20 comprises wired drill pipe. Referring to FIG. 4 with continued reference to FIGS. 1 and 2, the communication device 52 (also shown FIG. 2) that couples signals to the signal communication channel in the wired drill pipe is in signal communication with a telemetry transceiver 80 ("WDP transceiver") configured to communicate signals in the telemetry format used for the wired drill pipe. The WDP transceiver 80 may be unidirectional, transmitting data in one direction, or bidirectional, transmitting data in two directions.

A command decoder 82 may interrogate the telemetry signals from the WDP transceiver 80 to detect commands originating from the surface recording unit 38 shown in FIG. 1. Such commands may comprise instructions to, for example, operate a formation sampling one of the wireline configurable instruments 10 to extract samples from the formation 11 through the sampling instrument 10. Commands may also comprise instructions to send different instrument measurement signals from the wireline configurable toolstring 13 to the surface recording unit 38 over the wired drill pipe of the tubular string 20. Time/depth records may also be detected in the command decoder 82.

As the tubular string 20 is conveyed within the wellbore 18, the axial position in the wellbore (i.e., depth) of a reference point on the tubular string 20 or the wireline configurable toolstring 13 may be utilized to indicate the depth of one or more sensors of the wireline configurable toolstring 13 and/or a wireline configurable instrument 10. The depth may be determined by measuring the elevation of the top drive 26 and adding to said elevation the length of the individual components of the tubular string 20 and wireline configurable toolstring 13. The elevation may be recorded automatically in the surface recording unit 38 by utilizing appropriate sensors on the drilling rig 24. Thus, at any time, the depth of any sensor and/or reference point of the tubular string 20 and wireline configurable toolstring 13 may be determined. The time/depth data may be transmitted to the power sub 12 and utilized by the command decoder 82 to generate a record in mass storage 84 of the power sub 12 with respect to depth of measurements made by the various sensors in the wireline configurable toolstring 13.

The command decoder 82 may transmit instructions to change the data sent over the wired drill pipe of the tubular string 20 to an intermediate telemetry transceiver 86 of the power sub 12. The intermediate telemetry transceiver 86 receives well logging instrument measurements from the wireline configurable toolstring 13 by signal connection to a well logging instrument telemetry transceiver 88 in the wireline configurable toolstring 13. The well logging instrument telemetry transceiver 88 may be the same type as used in any wireline configurable well logging instrument string, and may be the same as is otherwise utilized to transmit signals via wireline when the wireline configurable toolstring 13 is deployed on a wireline instead of the tubular string 20. Well logging instrument signals that would be transmitted over the wireline if the wireline configurable tool string 13 were so connected may be communicated to the intermediate telemetry transceiver 86. Depending on the instruction from surface, such as from the surface recording system 38, some of the signals may be communicated to the WDP telemetry transceiver 80 for communication over the wired drill pipe communication channel. Remaining well logging instrument signals may be communicated to the mass data storage device 84, which may be a solid state memory or hard drive, among other storage devices within the scope of the present disclosure. The mass data storage device 84 may also receive and store the same signals that are transmitted to surface over the wired drill pipe communication channel. The WDP telemetry 80, the mass data storage 84, the command decoder 82 and/or the intermediate telemetry 86 may be enclosed in the power sub 12 and/or in a separate housing (not shown) that is itself coupled to the power sub 12 and/or the wireline configurable toolstring 13.

The measurements communicated to surface may be related to whether a particular action is to be undertaken by the automated or human system operator with respect to operation of one or more of the wireline configurable instruments 10. Such operation of the wireline configurable instrument 10 may utilize any information or data relevant to the operation or functioning of the instrument 10, including whether to continue operating the instrument 10 in the current manner of operation and/or to change an operation or function of the instrument 10. Such operation may also comprise determining whether the instrument 10 is moving (axially and/or rotationally) within the wellbore, and whether to continue the operation related to such movement. Operation related to movement of the instrument 10 may include, for example, lowering, raising and/or rotation of the tubular string 20 and/or the wireline configurable toolstring 13 within the wellbore 18, as well as the flow of fluid within the tubular string 20 and/or the flow of fluid caused by movement of the tubular string 20 relative to the wireline configurable toolstring 13, as further described below.

An example of a measurement that is utilized to determine whether to change an operation according to one or more aspects of the present disclosure entails a wireline configurable instrument 10 and/or the toolstring 13 that may be configured to transmit measurements to the surface recording system 38 over the wired drill pipe communication channel, or via mud-pulse telemetry, such that an automated or human system operator may determine whether a fluid sample being obtained from the formation 11 and/or wellbore 18 comprises mud filtrate or substantially native formation fluid. For example, one of the wireline configurable instruments 10 may comprise a spectrometer and/or other means for performing downhole fluid analysis (DFA) of the obtained fluid sample, such that identification of the obtained fluid sample may enable determining when to begin storing fluid withdrawn from the formation 11 or wellbore 18 in a sample storage tank of one of the wireline configurable instruments 10 (not shown). Such a sample may thus be retrieved to the surface for subsequent analysis. This operation, however, is merely an example of the possible functionality of the wireline configurable instruments 10 within the scope of the present disclosure.

Figure 5:
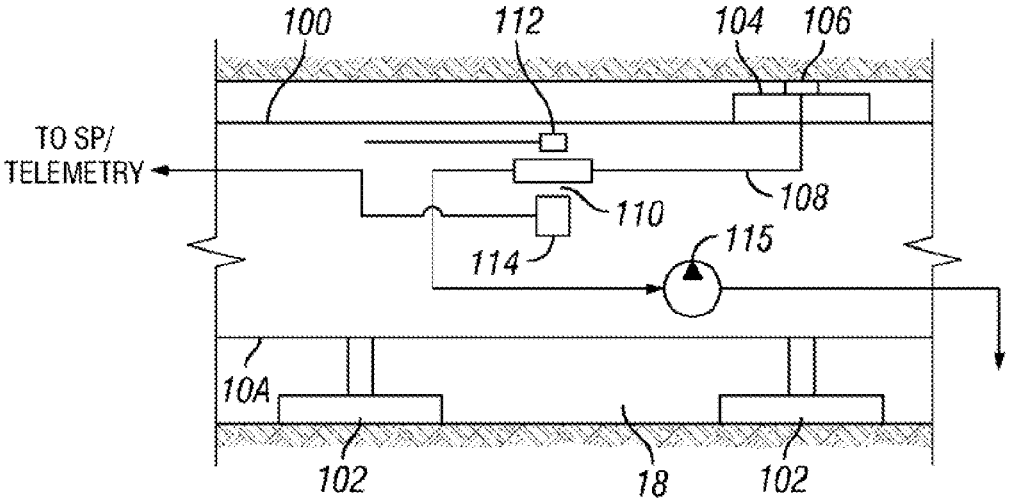
FIG. 5 is a schematic view of apparatus according to one or more aspects of the present disclosure.

Continuing with this example, FIG. 5 is a schematic view of an example wireline configurable instrument 10 operable for formation pressure testing and fluid sample taking according to one or more aspects of the present disclosure. For ease of understanding, such wireline configurable instrument 10 is designated by reference numeral 10A in FIG. 5, with the understanding that the wireline configurable instrument 10A is similar if not identical to the wireline configurable instrument 10 shown in FIG. 1, with the following additional details.

Thus, referring to FIG. 5 but with continued reference to FIGS. 1, 2 and 4, the formation testing instrument 10A may be deployed in the wellbore 18 as part of the wireline configurable toolstring 13 substantially as described above with reference to FIG. 1. When it is determined that the instrument 10A is disposed within a formation of interest, such as by monitoring gamma ray and/or other measurements made by one or more other instruments 10 of the toolstring 13, movement of the tubular string 20 may be stopped, and the instrument 10A may be operated to withdraw fluid samples from the formation 11. For example, such operation may comprise extending back-up pistons 102 from the instrument 10A into contact with the wall of the wellbore 18. Commands for such operation may be automatically or manually transmitted from surface to the instrument 10A. System components for deployment of such back-up pistons are well known in the art. By deploying the back-up pistons 102, the instrument 10A may be urged into contact with the wall of the wellbore 18 so that, for example, an elastomeric probe packer 104 or similar annular sealing element engages the wall of the wellbore 18.

The elastomeric probe packer 104 may seal against the wall of the wellbore 18 such that a fluid sample probe 106 disposed inside the elastomeric probe packer 104 may engage the formation 18 that forms the wall of wellbore 18, as shown in FIG. 5. A pump 115 of the instrument 10A and/or another one of the wireline configurable instruments 10 may pump fluid from the formation 11 by, for example, reducing pressure within the probe 106. Consequently, fluid from the formation 11 may flow through the probe 106 and into one or more flowlines 108 of the instrument 10A and/or another one of the wireline configurable instruments 10. As the obtained formation fluid is moved through the one or more flowlines 108, it may enter a test chamber 110 in fluid communication with the one or more flowlines 108. The test chamber 110 may comprise a radiation transparent tube and/or similar structures utilized to perform such testing of a static sample of the obtained formation fluid and/or to perform continuous, real time testing of formation fluid as it continuously flows through the test chamber 110. Continued operation of the pump 115 may move the obtained formation fluid out of the test chamber 110 and into the wellbore 18. Such fluid discharge, which may also be known as a "pump out" operation, may be performed until mud filtrate and/or other contamination of the obtained formation fluid, as measured by the test chamber 110, is reduced to an acceptable level. Thereafter, the subsequently obtained formation fluid may be stored in one or more sample storage chambers of the instrument 10A.

During such operation of the wireline configurable instrument 10A to obtain, test and/or capture one or more samples of fluid obtained from the formation 11, an energy source 112 may irradiate the fluid in the test chamber 110. Such irradiation may comprise different wavelengths of light, perhaps including infrared, ultraviolet and/or visible wavelengths. One or more detectors 114 may receive such irradiation as modified by the fluid present in the test chamber 110. For example, the one or more detectors 114 may comprise one or more spectrometers having multiple channels each corresponding to a different wavelength of light that corresponds to a measured spectrum, perhaps including infrared, ultraviolet and/or visible wavelengths. The output of each channel may represent an optical density (i.e., the logarithm of the ratio of incident light intensity to transmitted light intensity), where an optical density of zero (0) corresponds to 100% light transmission and an optical density of one (1) corresponds to 10% light transmission. The combined optical density output of the multiple channels provides spectral information that may be utilized to determine the composition, contamination, phase (liquid and/or gas), color, density and/or other properties of the obtained fluid.

Signals from the one or more detectors 114 may be communicated to the telemetry unit 88 of the wireline configurable toolstring 13 and/or a similar telemetry device of the power sub 12, which may then be transmitted to surface, such as to the surface recording system 38. Consequently, an automated and/or human system operator may receive substantially continuous and/or instantaneous measurements of one or more properties of the obtained formation fluid. The system operator may utilize such information to determine, for example, when the instrument 10A may be reconfigured to store a sample of the obtained fluid in one or more sample storage chambers of the instrument 10A and/or another one of the instruments 10. Alternatively, or additionally, the power sub 12 may comprise a microprocessor and/or other electronic controller or device having logic operable to determine from the fluid measurements when a sufficient percentage of the obtained fluid substantially or entirely comprises native formation fluid, and to automatically reconfigure the instrument 10A to store one or more samples of the obtained fluid. The power sub 12 may also automatically request information and/or data from surface to determine the fluid property measurements and/or to control operation of the instrument 10A.

Measurements made by various other sensors in the wireline configurable toolstring 13 may also or alternatively provide indication of whether certain operating conditions exist or have been met. The following description is stated in terms of providing an indication to the automated and/or human system operator such that the system operator may take certain action in response. However, the measurements may also or alternatively be utilized to automatically trigger one or more actions, such as described above with respect to reconfiguring the wireline configurable instrument 10A, for example. One or more measurements of one or more operating conditions made by one or more sensors in the wireline configurable toolstring 13 may also be utilized to effect one or more automatic changes in one or more operations of the toolstring 13, as well as one or more operations of the drilling rig 24. Thus, any reference herein to the automated or human system operator acting in response to a measurement may also be applicable or readily adaptable to automatic performance of substantially the same action.

The energy source 112 and one or more detectors 114 may be any types suitable for determining one or more properties of the fluid obtained from the formation 11, such as to enable discrimination between mud filtrate and native formation fluid. Thus, the test chamber 110 or a window thereof may comprise a material is transparent to the specific radiation utilized to analyze the fluid therein. Accordingly, in the context of the present disclosure, the term "radiation" is intended to include energy which may travel through the wall or window of the test chamber 110 and be somehow modified as it traverses the fluid therein, thereby giving rise to a detectable effect in the measurements made by the one or more detectors 114 based on the origin of the fluid. Thus, in addition to the above-described example of an optical light source and one or more multi-channel sensors operating in the infrared, ultraviolet and/or visible wavelengths to measure optical density, other examples may include one or more electrical resistivity current sources and measurement electrodes, one or more induction transmitters and receiver coils, one or more nuclear magnetic resonance (NMR) transmitters and receiver antennas (such as to measure NMR relaxation properties), one or more gamma ray sources and detectors (such as to measure density), one or more neutron sources and detectors (such as to measure hydrogen index and/or neutron capture cross section), one or more high frequency electromagnetic radiation sources and detectors (such as to measure dielectric constant), and/or one or more acoustic sources and detectors (such as to measure apparent sound velocity). However, other source/detector combinations are also within the scope of the present disclosure.

The above description is provided in the context of obtaining fluid from the formation 11. However, one or more aspects thereof may also be applicable or readily adaptable to obtaining fluid from the wellbore 18 and/or surface equipment, as well as to obtaining a core sample from the formation 11.

Figure 6:
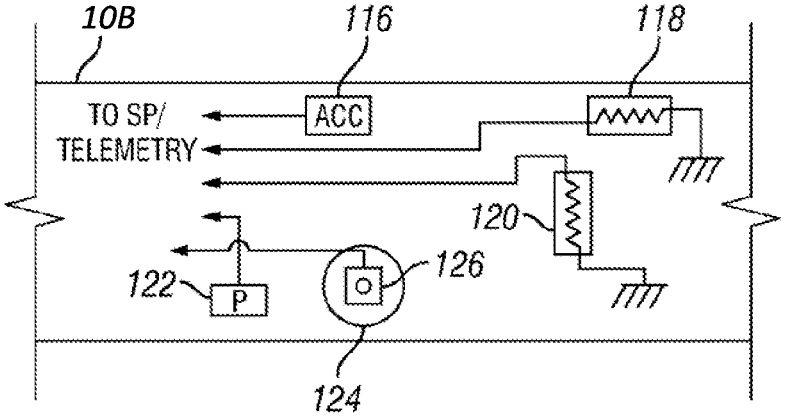
FIG. 6 is a schematic view of apparatus according to one or more aspects of the present disclosure.

As mentioned above, the wireline configurable toolstring 13 may include one or more sensors for measuring and/or detecting movement of the toolstring 13 within the wellbore 18, such that the system operator may be alerted to conditions of the wellbore, the toolstring 13 and/or the tubular string 20 that, for example, may expose the operation to risk of injury, loss and/or damage. FIG. 6 is a schematic view of an example wireline configurable instrument 10 operable to obtain such measurements. For ease of understanding, such wireline configurable instrument 10 is designated by reference numeral 10B in FIG. 6, with the understanding that the wireline configurable instrument 10B is similar if not identical to the wireline configurable instrument 10 shown in FIG. 1, with the following additional details.

Thus, referring to FIG. 6 but with continued reference to FIGS. 1, 2 and 4, the wireline configurable instrument 10B may comprise one or more strain gauges 118 disposed on or near an exterior surface of the instrument 10B such that changes in axial loading on the instrument 10B may be determined. One or more additional strain gauges 120 may also be disposed on or near the exterior surface of the instrument 10B such that changes in torsion and/or bending strain on the instrument 10B may be determined. One or more accelerometers 116 may also be disposed in or on the instrument 10B, such as to determine changes in velocity of the instrument 10B as it traverses the wellbore 18. One or more pressure sensors 122 may also be disposed in the instrument 10B, such as to measure pressure outside the instrument 10B, pressure of the wellbore 18, and/or pressure of fluid within the wellbore 18. The one or more pressure sensors 122 may be responsive to formation fluid pressure as the instrument 10B is conveyed within the wellbore. Rotational orientation (azimuth) of the instrument 10B may also be determined, for example, utilizing one or more magnetometers and/or accelerometers suitably arranged with respect to a plane normal to the longitudinal axis of the instrument 10B. For implementations in which the tubular string 20 comprises wired drill pipe, the one or more strain gauges 118 and/or 120, the one or more accelerometers 116, and/or the one or more pressure sensors 122 may be positioned on or within repeaters that may be present in the string of wired drill pipe.

One or more of the above-described sensors and/or measurements may be utilized to determine if the wireline configurable toolstring 13 is moving in an axial and/or rotary fashion. Such measurements may be communicated to the surface recording system 38 by the telemetry unit 88 of the toolstring 13 and/or the power sub 12. For example, the strain gauges 118 and/or 120 may detect an increase in axial strain, such as may result from compression as the toolstring 13 moves toward the end of the wellbore 18 or tension as the toolstring 13 moves away form the end of the wellbore 18. A substantial increase in such tension may indicate that the toolstring 13 has become stuck in the wellbore 18. The system operator may thus be able to take action before the toolstring 13 and/or the instruments 10, 10A and/or 10B are damaged by the excessive axial strain. Corresponding indications and actions may be taken with respect to torsional strain by using the one or more torsional strain gauges 120, for example.

In implementations where one of the wireline configurable instruments 10 is configured to measure resistivity, the resistivity measurements may be utilized to determine if the instrument 10 is moving along the wellbore 18. For example, resistivity measurement devices that may be suited to provide such measurements may include those identified by the service marks SFL, MICROLOG, MICCROLATEROLOG and LATEROLOG 8, which are commercially available from SCHLUMBERGER TECHNOLOGY CORPORATION and/or its affiliate(s). Movement of the instrument 10 may be determined utilizing any of the foregoing, such as by observing measurements between successive interrogations of the instrument 10. Such instrument 10 may have sufficiently small axial resolution that a constant measurement value between successive measurements, whether time or depth based, may be indicative of the instrument 10 not moving within the wellbore 18. Non-movement of the instrument 10 while the top drive 26 is moving axially may indicate heightened risk of damage to or loss of the wireline configurable toolstring 13, and may suggest monitoring of axial strain and/or other measurements to reduce the risk.

The one or more accelerometers 116 may be interrogated and its measurements integrated to determine an estimated velocity of the instrument 10 or toolstring 13. Velocity of the tubular string 20 may be estimated by measuring position of the top drive 26 with respect to time. Integrated acceleration measurements that differ from the top drive velocity measurements by more than a predetermined threshold may indicate, for example, that the instrument 10 or toolstring 13 is becoming or has become stuck in the wellbore 18. Consequently, action may be taken to avoid damage, such as automatically or manually transmitting control signals from surface and/or a downhole component of the wireline configurable toolstring 13.

Measurements from the one or more pressure sensors 122 may also be communicated to the surface recording system 38. The system operator may thus monitor such measurements. Alternatively, or additionally, such measurements may be compared to expected pressure in the wellbore annulus defined between the wall of the wellbore 18 and the toolstring 13, whether by the system operator, the surface recording system 38 and/or another component at surface and/or downhole. The expected pressure is related to the density of the drilling fluid 30, gravitational acceleration and vertical depth within the wellbore 18. If the expected annulus pressure exceeds the measured pressure by a predetermined amount, the system operator may be alerted to the possibility that the instrument 10 may become stuck in the wellbore 18 as a result of differential pressure.

Measurements from the one or more accelerometers 116 may also be integrated to determine position of the toolstring 13 with respect to time. Such position information from the integrated acceleration measurements may be utilized to determine position and/or motion of the toolstring 13 with respect to position and/or motion the tubular string 20. Such position information may also be utilized to calibrate information about the depth of a particular sensor in the toolstring 13 in the wellbore 18, which may be inferred from measurements of the elevation of the top drive 26, the length of the various components of the tubular string 20 and the wireline configurable toolstring 13, and the longitudinal position of the particular sensor on/in the particular instrument 10.

One or more of the wireline configurable instruments 10 of the toolstring 13 may also comprise a rotary encoder 126 rotationally coupled to a frictional contact wheel 124 that may be in contact with the wall of the wellbore 18. The frictional contact wheel 124 may rotate an amount corresponding to axial movement of the toolstring 13 within the wellbore 18. The encoder 126 may thus generate a signal corresponding to the axial movement of the toolstring 13 within the wellbore. Such signal may be communicated to the surface recording system 38, whether along with or instead of the above-described acceleration measurements, such as to calibrate depth measurements based on position of the tubular string 20 as a result of differential movement of the instrument 10 with respect to the elevation of the top drive 26.

Measurements made by the one or more accelerometers 116 and/or the strain gauges 118 and/or 120 may be compared to peak values associated with damaging shock to one or more of the instruments 10. The accelerometer measurements may be directly proportional to the shock applied to the instrument 10. For measurements made utilizing the strain gauge 118 and/or 120, the shock applied to the instrument 10 may be related to the acceleration and the inertia of the instrument 10. The inertia of the instrument 10 may be related to its mass and/or rotational moment of inertia. Indication of shock applied to the instrument 10 in excess of safe levels may provide the system operator with warning to adjust operations of the drilling rig 24 to avoid damage to the instrument 10.

Pressure measurements obtained utilizing the one or more pressure sensors 122 that exceed a predetermined threshold may also indicate to the system operator that operation of the drilling rig 24 should be adjusted, such as by raising the toolstring 13 within the wellbore 18 and/or reducing hydrostatic pressure in the wellbore 18 by reducing drilling fluid density and/or reducing fluid pressure applied at surface. Such action may be taken automatically, perhaps in response to corresponding control signals from surface and/or a component of the toolstring 13.

One or more of the wireline configurable instruments 10 and/or another component or module of the wireline configurable toolstring 13 may also comprise an additional one or more features that are selectively extendable into contact with the wall of the wellbore 18. The one or more selectively extendable features may be operable to anchor the toolstring 13 within the wellbore 18, thus preventing axial and rotary motion of the toolstring 13 relative to the wellbore 18.

Figure 7:
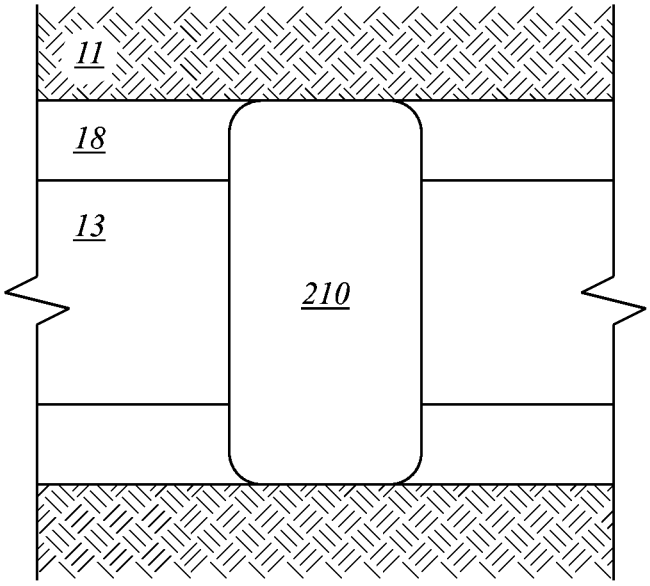
FIG. 7 is a schematic view of apparatus according to one or more aspects of the present disclosure.

FIG. 7 is a schematic view of an example of such an extendable feature 210 having been extended from the wireline configurable toolstring 13 into contact with the wall of the wellbore 18. The extendable feature 210 is a packer that is inflatable by operating a pump of the toolstring 13, such as the pump 115 shown in FIG. 5, to fill the packer with hydraulic fluid, drilling fluid received from surface, wellbore fluid obtained from the annulus between the toolstring 13 and the wall of the wellbore 18, and/or other fluid. The extendable feature 210 may alternatively be a mechanically expandable packer. Moreover, whether hydraulically or mechanically operated, the packer may comprise a port (not shown) configured to seal against the wall of the wellbore 18 and obtain fluid from the formation 11 in much the same manner as the probe 106 shown in FIG. 5, whether in addition to or instead of the probe 106.

Figure 8:
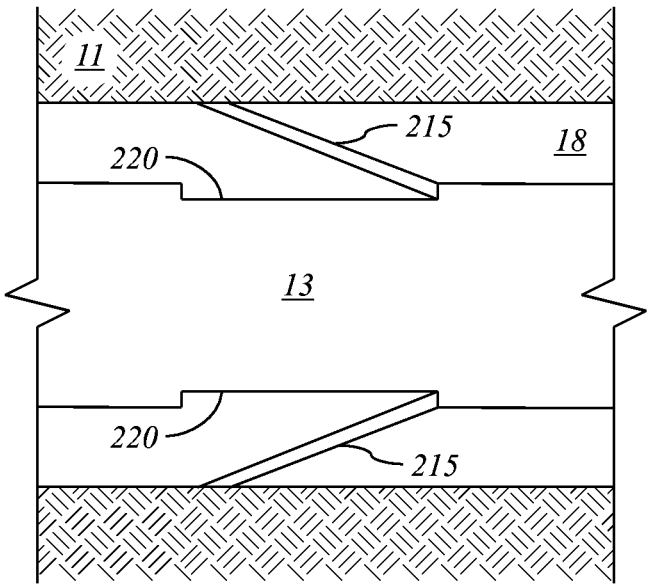
FIG. 8 is a schematic view of apparatus according to one or more aspects of the present disclosure.

FIG. 8 is a schematic view of another example extendable feature comprising a plurality of arms 215 configured to pivot or otherwise extend away from the wireline configurable toolstring 13 into contact with the wall of the wellbore 18. Extension and retraction of the plurality of arms 215 may be via operation of an electric or hydraulic motor and/or other actuator of the toolstring 13. As also shown in FIG. 8, the outer profile of the toolstring 13 may comprise one or more recesses 220 configured to receive the arms 215 when retracted, thus minimizing or perhaps eliminating the possibility of the arms 215 inadvertently impinging on the wall of the wellbore 18 or protrusions therefrom when the arms 215 are retracted.

As described above with respect to FIG. 1, the pump 32 may be operated to provide fluid flow to operate one or more turbines or impellers in the wireline configurable toolstring 13 and/or the power sub 12 to provide electrical power to operate one or more wireline configurable instruments 10 in the wireline configurable toolstring 13. However, the wireline configurable toolstring 13 may also or alternatively comprise an impeller driven by fluid flow resulting from reciprocation of the toolstring 13 relative to the tubular string 20 according to one or more aspects of the present disclosure.

Figure 9:
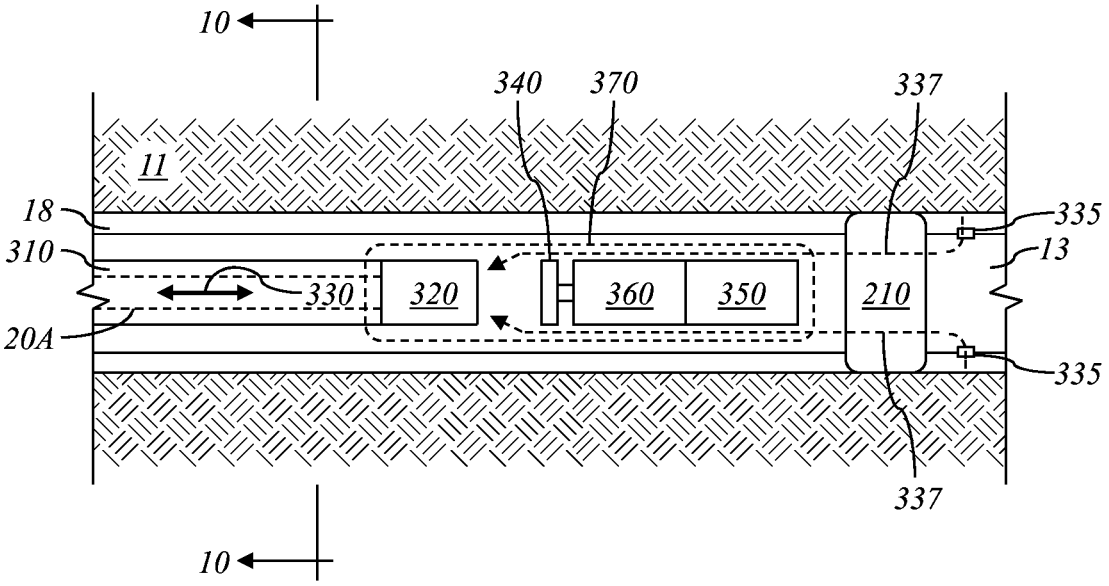
FIG. 9 is a schematic view of apparatus according to one or more aspects of the present disclosure.

Such reciprocation may comprise axial reciprocation of a piston 310 or other portion of the tubular string 20 (hereafter collectively referred to as the piston 310) within a cylinder 320 the wireline configurable toolstring 13. As shown in FIG. 9, the axial reciprocation may be in opposing directions that are substantially parallel to a longitudinal axis of the tubular string 20, as indicated by arrow 330. The cylinder 320 of the toolstring 13 may be in fluid communication with one or more ports 335 of the toolstring 13. As such, the piston 310 within the cylinder 320 may draw fluid from the wellbore 18 into the toolstring 13 as the piston 310 axially translates away from the toolstring 13 and, thus, out of the cylinder 320. The fluid thus drawn from the wellbore 18 may at least partially fill the cylinder 320 and/or another chamber of the toolstring 13 (hereafter collectively referred to as the cylinder 320), as indicated in FIG. 9 by arrows 337. Thereafter, axial translation of the piston 310 back towards the toolstring 13 and into the cylinder 320 may expel fluid from the cylinder 320 back out the one or more ports 335 and into the wellbore 18 in a direction that is generally the reverse of the arrows 337. Thus, axial reciprocation of the piston 310 relative to the toolstring 13 generates an alternating wellbore fluid flow into and out of the cylinder 320.

The toolstring 13 may comprise an impeller 340 in the path of this alternating fluid flow driven by the axial reciprocation of the piston 310 relative to the cylinder 320. The impeller 340 may be bidirectional, such that the fluid flow driven by the axial reciprocation of the piston 310 relative to the cylinder 320 may impart rotary motion to the impeller 340 in a single rotational direction regardless of the axial direction of the fluid flow relative to the impeller 340. The impeller 340 may alternatively be unidirectional, such that the fluid flow driven by the axial reciprocation of the piston 310 relative to the cylinder 320 in a first axial direction may impart rotary motion to the impeller 340, but the fluid flow in the opposite axial direction may not impart rotary motion to the impeller 340.

The toolstring 13 may also comprise an alternator 350 to which rotary motion of the impeller 340 may be directly or indirectly imparted. For example, the impeller 340 may be directly coupled to an input of the alternator 350, such that any rotation of the impeller 340 is directly imparted to the alternator 350. Alternatively, a gearbox or other gearing 360 may be coupled between the impeller 340 and the alternator 350. For example, the impeller 340 may be directly coupled to an input of the gearing 360, such that any rotation of the impeller 340 is directly imparted to the gearing 360. The gearing 360 is configured such that any rotary motion of its input may be directly or indirectly imparted to an output of the gearing 360. For example, the gearing 360 may operate such that the rotational speed of its output may be increased or reduced relative to the rotational speed of its input. Rotary motion of the output of the gearing 360 may be indirectly imparted to the input of the alternator 350. Alternatively, rotary motion of the output of the gearing 360 may be directly imparted to the input of the alternator 350, as schematically depicted in FIG. 9.

Whether the rotary motion of the impeller 340 is imparted directly to the input of the alternator 350, or imparted indirectly via the gearing 360 and/or other components of the toolstring 13, the alternator 350 converts the input rotary motion into electrical energy. This electrical energy may be stored in one or more batteries or other energy storage devices of the toolstring 13. Alternatively, or additionally, the electrical energy converted from rotary motion by the alternator 350 may be directed to one or more of the wireline configurable instruments 10 of the toolstring 13 and/or a power bus (not shown) to which one or more of the wireline configurable instruments 10 may be electrically coupled.

Thus, a wireline configurable toolstring 13 according to one or more aspects of the present disclosure may comprise a converter 370 configured to convert fluid flow driven by axial reciprocation of the piston 310 relative to the cylinder 320. The converter 370 may comprise one or more of the cylinder 320, the impeller 340, the gearing 360 and the alternator 350. Additionally, the alternator 350 may instead be a generator. As described above, use of the terms "generator" and "alternator" herein is intended to be interchangeable, in that use of either direct current electric generators or alternating current generators is within the scope of the present disclosure, and the term "alternator" as used herein, including in the claims, may include both types of devices within its scope.

The above description of axial reciprocation of the piston 310 relative to the cylinder 320 is provided in the context of the converter 370 being disposed within the wireline configurable toolstring 13. However, one or more aspects of the converter 370, its operation, and its interworking with the piston 310 and the cylinder 320 may be applicable or readily adaptable to at least a portion of the converter 370 being disposed within the power sub 12 shown in FIGS. 1, 2 and 4. For example, the impeller 340 of the converter 370 may be the impeller 41 shown in FIG. 2. In such implementations, the piston 310 and/or the cylinder 320 may be part of the power sub 12 and/or the toolstring 13. However, in implementations in which the entirety of the converter 370 is disposed of the toolstring 13 and not the power sub 12, the power sub 12 may be omitted.

Figure 10:
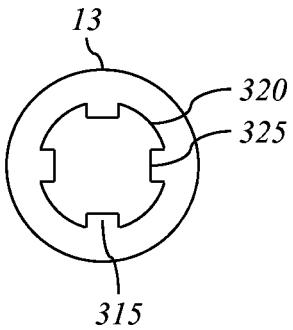
FIG. 10 is a schematic view of apparatus according to one or more aspects of the present disclosure.

FIG. 10 is a cross-section schematic view of the piston 310 and the cylinder 320 shown in FIG. 9 illustrating one example of the interface between the piston 310 and the cylinder 320 permitting relative axial reciprocation thereof. As shown in FIG. 10, the piston 310 may comprise one or more recesses 325 each configured to receive a corresponding keyed member 315 of the cylinder 320. Although four (4) keyed members 315 and recesses 325 are depicted in FIG. 10, other implementations within the scope of the present disclosure may comprise any other number of keyed members 315 and recesses 325. Additionally, the keyed members 315 and recesses 325 are depicted in FIG. 10 as being disposed at regular angular intervals around the longitudinal axis of the piston 310 and the cylinder 320. However, the keyed members 315 and recesses 325 may be disposed at different angular intervals, perhaps including in a manner permitting assembly of the piston 310 and cylinder 320 in a single rotational (azimuth) orientation.

The fluid flow driven by the relative axial reciprocation of the tubular string 20 and the wireline configurable toolstring 13 may also be supplemented by additional fluid flow. For example, the flow of drilling fluid between the toolstring 13 and surface via an internal passage 20A of the tubular string and/or the annulus defined between the wall of the wellbore 18 and the tubular string 20 may also be utilized with the fluid flow generated by reciprocation of the tubular string 20 relative to the toolstring 13 to further impart rotary motion to the impeller 340.

The relative axial reciprocation of the tubular string 20 and the wireline configurable toolstring 13 may also be partially facilitated by anchoring the wireline configurable toolstring 13 relative to the wellbore 18. For example, the extendable packer 210 shown in FIGS. 7 and 9 and/or the extendable arms 215 shown in FIG. 8 may be utilized to anchor the toolstring 13 and thereby fix the axial position (depth) of the toolstring 13 within the wellbore 18. Other means for fixing the axial position of the toolstring 13 within the wellbore 18 are also within the scope of the present disclosure. Moreover, other implementations within the scope of the present disclosure may not entail fixing the axial position of the toolstring 13 within the wellbore 18 while the tubular string 20 axially reciprocates relative to the toolstring 13. That is, the wireline configurable toolstring 13 may be moving axially within the wellbore 18 while the tubular string 20 simultaneously reciprocates axially relative to the axially moving toolstring 13. Such axial motion of the toolstring 13, even while the tubular string 20 is axially reciprocating, may be passive, perhaps resulting merely from friction between the toolstring 13 and the tubular string 20. Alternatively, such axial motion of the toolstring 13 may be active, such as in implementations in which an open-hole or cased-hole tractor mechanism coupled to the toolstring 13 is utilized to convey the toolstring 13 within the wellbore 18.

Figure 11:
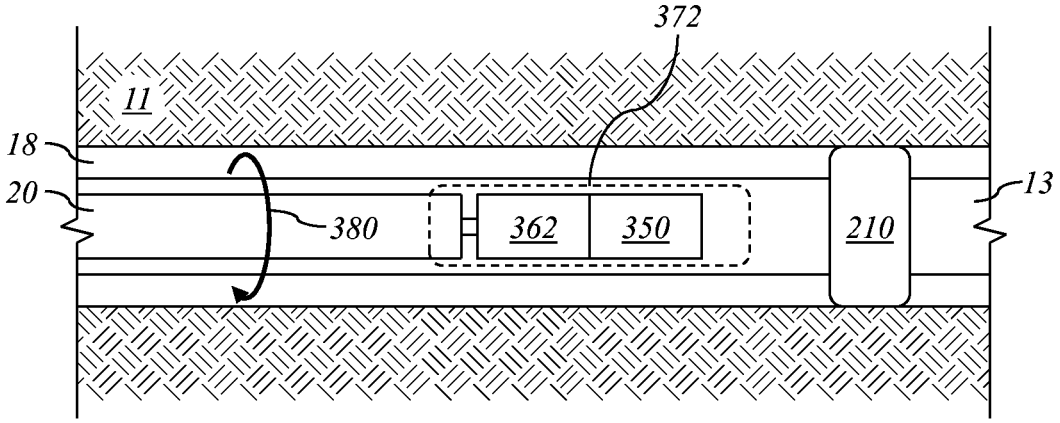
FIG. 11 is a schematic view of apparatus according to one or more aspects of the present disclosure.

FIG. 11 is a schematic view of an alternative implementation of the tubular string 20 and the wireline configurable toolstring 13 according to one or more aspects of the present disclosure. Instead of imparting rotary motion to the alternator 350 with fluid flow generated by axially reciprocating the tubular string 20 relative to the toolstring 13, rotary motion may be at least indirectly imparted to the alternator 350 by rotation of the tubular string 20 relative to the wireline configurable toolstring 13. Such rotation is indicated in FIG. 11 by arrow 380.

As with the implementation depicted in FIG. 9, the wireline configurable toolstring 13 shown in FIG. 11 may also comprise gearing 362. However, whereas the gearing 360 shown in FIG. 9 may be coupled between the impeller 340 and the alternator 350, the gearing 362 shown in FIG. 11 may be directly coupled between the tubular string 20 and the alternator 350. Alternatively, the gearing 362 may be indirectly coupled to the tubular string 20 via one or more mechanical components (not shown). In any case, the rotary motion of the tubular string 20 relative to the wireline configurable toolstring 13 is imparted (directly or indirectly) to an input of the gearing 362. The gearing 362 is configured such that any rotary motion of its input may be directly or indirectly imparted to its output. For example, the gearing 362 may operate such that the rotational speed of its output may be increased or reduced relative to the rotational speed of its input. Rotary motion of the output of the gearing 362 may be indirectly imparted to the input of the alternator 350. Alternatively, rotary motion of the output of the gearing 362 may be directly imparted to the input of the alternator 350, as schematically depicted in FIG. 11.

Whether the rotary motion of the tubular string 20 is imparted directly to the input of the alternator 350, or imparted indirectly via the gearing 362 and/or other components of the toolstring 13, the alternator 350 converts the input rotary motion into electrical energy. This electrical energy may be stored in one or more batteries or other energy storage devices of the toolstring 13. Alternatively, or additionally, the electrical energy converted from rotary motion by the alternator 350 may be directed to one or more of the wireline configurable instruments 10 of the toolstring 13 and/or a power bus to which one or more of the wireline configurable instruments 10 may be electrically coupled.

Thus, a wireline configurable toolstring 13 according to one or more aspects of the present disclosure may comprise a converter 372 configured to convert rotary motion of the tubular string 20 relative to the toolstring 13 into electrical energy that may be utilized to power one or more of the wireline configurable instruments 10 of the toolstring 13. The converter 372 may comprise the gearing 362 and the alternator 350, as well as any mechanisms mechanically coupling the gearing 362 between the tubular string 20 and the alternator 350. Moreover, as described above, the alternator 350 may alternatively be a generator.

The above description of rotation of the tubular string 20 relative to the wireline configurable toolstring 13 is provided in the context of the converter 372 being disposed within the toolstring 13. However, one or more aspects of the converter 372, its operation, and/or its interworking with the tubular string 20 and the toolstring 13 may be applicable or readily adaptable to implementations in which at least a portion of the converter 372 is disposed within the power sub 12 shown in FIGS. 1, 2 and 4. Moreover, in implementations in which the entirety of the converter 372 is disposed in the toolstring 13 and not the power sub 12, the power sub 12 may be omitted.

Figure 12:
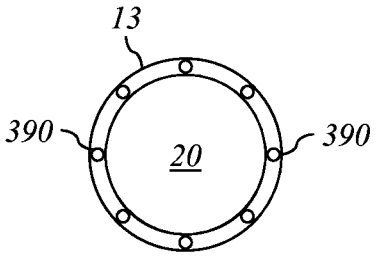
FIG. 12 is a schematic view of apparatus according to one or more aspects of the present disclosure.

FIG. 12 is a cross-section schematic view of the tubular string 20 and the wireline configurable toolstring 13 shown in FIG. 11 illustrating one example of the rotating interface between the tubular string 20 and toolstring 13. As shown in FIG. 12, the toolstring 13 may comprise one or more rotary bearings 390 configured to support the tubular string 20 as it rotates relative to the toolstring 13. However, other implementations within the scope of the present disclosure may comprise additional or alternative means for such support.

The relative rotation of the tubular string 20 and the wireline configurable toolstring 13 may be partially facilitated by anchoring the wireline configurable toolstring 13. For example, the extendable packer 210 shown in FIGS. 7 and 11 and/or the extendable arms 215 shown in FIG. 8 may be utilized to anchor the toolstring 13 and thereby fix the axial position (depth) and/or angular orientation (azimuth) of the toolstring 13 within the wellbore 18. Other means for fixing the position of the toolstring 13 within the wellbore 18 are also within the scope of the present disclosure. Moreover, other implementations within the scope of the present disclosure may not entail fixing the position of the toolstring 13 within the wellbore 18 while the tubular string 20 rotates relative to the toolstring 13. That is, the wireline configurable toolstring 13 may be moving axially within the wellbore 18 while the tubular string 20 simultaneously rotates relative to the axially moving toolstring 13. Such axial motion of the toolstring 13 may be active, such as in implementations in which an open-hole or cased-hole tractor mechanism coupled to the toolstring 13 conveys the toolstring 13 within the wellbore 18.

In view of the above and the figures, those of ordinary skill in the art will readily recognize that the present disclosure introduces a method comprising: conveying a wireline configurable toolstring within a wellbore extending into a subterranean formation via a tubular string to which the wireline configurable tool string is coupled in a manner permitting relative reciprocation of the wireline configurable toolstring and the tubular string; and reciprocating the tubular string relative to the wireline configurable toolstring within the wellbore; wherein the wireline configurable toolstring: converts fluid flow resulting from the tubular string reciprocation into electrical energy; and comprises at least one wireline configurable instrument powered by the electrical energy. The wireline configurable instrument may be to measure a characteristic, an electrical property, electrical resistivity, electrical conductivity, a sonic property, a nuclear property, a physical property, a pressure, a temperature and/or a porosity of the subterranean formation. The wireline configurable instrument may be to measure a dimensional property of the wellbore. The wireline configurable instrument may be to obtain a fluid sample and/or a core sample from the subterranean formation. The conveying and the reciprocating may be simultaneous.

The tubular string may comprise a drillstring, and perhaps wired drill pipe. Reciprocating the tubular string may comprise axially reciprocating the tubular string relative to the wireline configurable toolstring in opposing directions substantially parallel to a longitudinal axis of the tubular string. Axially reciprocating the tubular string may comprise alternately raising and lowering a drilling rig traveling block to which the tubular string is at least indirectly coupled. Alternately raising and lowering a drilling rig traveling block may comprise operating a drilling rig drawworks to alternately reel in and out a cable of the drawworks, wherein the cable may be coupled at least indirectly to the traveling block. Reciprocating the tubular string may comprise holding a floating drilling rig traveling block stationary relative to the floating drilling rig as motion of waves on which the floating drilling rig may float alternately raises and lowers the floating drilling rig.

The fluid flow may comprise at least one of: fluid flow into an internal chamber of the wireline configurable toolstring in response to the axial reciprocation of the tubular string relative to the wireline configurable toolstring; and fluid flow out of the internal chamber of the wireline configurable toolstring in response to the axial reciprocation of the tubular string relative to the wireline configurable toolstring. The at least one of fluid flow into the internal chamber and fluid flow out of the internal chamber may at least indirectly impart rotary motion to an input of an alternator of the wireline configurable toolstring. The at least one of fluid flow into the internal chamber and fluid flow out of the internal chamber may impart rotary motion to an impeller of the wireline configurable toolstring, and the rotary motion of the impeller may at least indirectly impart rotary motion to an input of an alternator of the wireline configurable toolstring. The method may further comprise subjecting the impeller to fluid flowing between the wireline configurable toolstring and surface equipment via at least one of an internal passage of the tubular string and an annulus defined between a wall of the wellbore and the tubular string. The impeller may be a mono-directional impeller, such that one of fluid flow into the internal chamber and fluid flow out of the internal chamber may impart rotary motion to the impeller but the other of fluid flow into the internal chamber and fluid flow out of the internal chamber may not impart rotary motion to the impeller. The at least one of fluid flow into the internal chamber and fluid flow out of the internal chamber may impart rotary motion to an impeller of the wireline configurable toolstring, wherein the rotary motion of the impeller may at least indirectly impart rotary motion to an input of a gearing of the wireline configurable toolstring, wherein the rotary motion of the input of the gearing may indirectly impart rotary motion to an output of the gearing, and wherein the rotary motion of the output of the gearing may at least indirectly impart rotary motion to an input of an alternator of the wireline configurable toolstring.

The method may further comprise anchoring the wireline configurable toolstring within the wellbore. The wellbore may comprise a substantially vertical length and a substantially non-vertical length, and anchoring the wireline configurable toolstring within the wellbore may comprise anchoring the wireline configurable toolstring within the substantially non-vertical length of the wellbore. Anchoring the wireline configurable toolstring within the wellbore may comprise extending a feature of the wireline configurable toolstring into contact with the wellbore. The feature may comprise an inflatable packer, a mechanically expandable packer and/or a plurality of arms.

The present disclosure also introduces a method comprising: conveying a wireline configurable toolstring within a wellbore extending into a subterranean formation via a tubular string to which the wireline configurable tool string is coupled; and rotating the tubular string relative to the wireline configurable toolstring within the wellbore; wherein the wireline configurable toolstring: converts the tubular string rotation relative to the wireline configurable toolstring into electrical energy; and comprises at least one wireline configurable instrument powered by the electrical energy. The wireline configurable instrument may be to measure a characteristic, an electrical property, electrical resistivity, electrical conductivity, a sonic property, a nuclear property, a physical property, a pressure, a temperature and/or a porosity of the subterranean formation. The wireline configurable instrument may be to measure a dimensional property of the wellbore. The wireline configurable instrument may be to obtain a fluid sample and/or a core sample from the subterranean formation. The conveying and the rotating may be simultaneous.

The tubular string may comprise a drillstring, perhaps including wired drill pipe. Rotating the tubular string may comprise rotating a top drive of a drilling rig from which the tubular string is suspended. Rotating the tubular string relative to the wireline configurable toolstring may at least indirectly impart rotary motion to an input of an alternator of the wireline configurable toolstring. Rotating the tubular string relative to the wireline configurable toolstring may at least indirectly impart rotary motion to an input of gearing of the wireline configurable toolstring, wherein the rotary motion of the input of the gearing may indirectly impart rotary motion to an output of the gearing, and wherein the rotary motion of the output of the gearing may at least indirectly impart rotary motion to an input of an alternator of the wireline configurable toolstring.

The method may further comprise anchoring the wireline configurable toolstring within the wellbore. The wellbore may comprise a substantially vertical length and a substantially non-vertical length, and anchoring the wireline configurable toolstring within the wellbore may comprise anchoring the wireline configurable toolstring within the substantially non-vertical length of the wellbore. Anchoring the wireline configurable toolstring within the wellbore may comprise extending a feature of the wireline configurable toolstring into contact with the wellbore. The feature may comprise an inflatable packer, a mechanically expandable packer and/or a plurality of arms.

The present disclosure also introduces an apparatus comprising: a wireline configurable toolstring comprising: an interface to couple the wireline configurable toolstring with a tubular string in a manner permitting relative reciprocation of the wireline configurable toolstring and the tubular string, wherein the wireline configurable toolstring is conveyable within a wellbore extending into a subterranean formation via the tubular string; a converter of fluid flow resulting from relative reciprocation of the wireline configurable toolstring and the tubular string into electrical energy; and a wireline configurable instrument powered by electrical energy received from the converter. The wireline configurable instrument may be to measure a characteristic, an electrical property, electrical resistivity, electrical conductivity, a sonic property, a nuclear property, a physical property, a pressure, a temperature and/or a porosity of the subterranean formation. The wireline configurable instrument may be to measure a dimensional property of the wellbore. The wireline configurable instrument may be to obtain a fluid sample and/or a core sample from the subterranean formation.

The tubular string may comprise a drillstring, perhaps including wired drill pipe. The interface may be to couple the wireline configurable toolstring with the tubular string in a manner permitting axial reciprocation of the wireline configurable toolstring and the tubular string in opposing directions substantially parallel to a longitudinal axis of the tubular string.

The fluid flow resulting from relative reciprocation of the wireline configurable toolstring and the tubular string may comprise at least one of: fluid flow into an internal chamber of the wireline configurable toolstring; and fluid flow out of the internal chamber. The converter may comprise an alternator, and the at least one of fluid flow into the internal chamber and fluid flow out of the internal chamber may at least indirectly impart rotary motion to an input of the alternator. The converter may comprise an impeller and an alternator, wherein the at least one of fluid flow into the internal chamber and fluid flow out of the internal chamber may impart rotary motion to the impeller, and wherein the rotary motion of the impeller may at least indirectly impart rotary motion to an input of the alternator. Rotary motion may also be imparted to the impeller by fluid flowing between the wireline configurable toolstring and surface equipment via at least one of: an internal passage of the tubular string; and an annulus defined between a wall of the wellbore and the tubular string. The impeller may be a mono-directional impeller, such that one of fluid flow into the internal chamber and fluid flow out of the internal chamber may impart rotary motion to the impeller but the other of fluid flow into the internal chamber and fluid flow out of the internal chamber may not impart rotary motion to the impeller. The converter may comprise an impeller, an alternator, and a gearing between the impeller and the alternator, wherein the at least one of fluid flow into the internal chamber and fluid flow out of the internal chamber may impart rotary motion to the impeller, wherein rotary motion of the impeller may at least indirectly impart rotary motion to an input of the gearing, wherein the rotary motion of the input of the gearing may indirectly impart rotary motion to an output of the gearing, and wherein the rotary motion of the output of the gearing may at least indirectly impart rotary motion to an input of the alternator.

The wireline configurable toolstring may further comprise an extendable feature to extend from the wireline configurable toolstring into contact with a wall of the wellbore. The extendable feature may comprise an inflatable packer, a mechanically expandable packer and/or a plurality of arms. The wireline configurable toolstring may further comprise a power sub, and the wireline configurable instrument may also be powered by electrical energy received from the power sub.

The present disclosure also introduces a method comprising: conveying a wireline configurable toolstring within a wellbore extending into a subterranean formation via a tubular string to which the wireline configurable tool string is coupled in a manner permitting relative reciprocation of the wireline configurable toolstring and the tubular string, and reciprocating the tubular string relative to the wireline configurable toolstring within the wellbore, wherein the wireline configurable toolstring converts fluid flow resulting from the tubular string reciprocation into electrical energy, and wherein the wireline configurable toolstring comprises at least one wireline configurable instrument powered by the electrical energy. The conveying and the reciprocating may be simultaneous. The wireline configurable instrument may be to measure a characteristic of the subterranean formation. The characteristic may comprise at least one of an electrical property, a sonic property, a nuclear property and a physical property. The fluid flow may comprise at least one of: fluid flow into an internal chamber of the wireline configurable toolstring in response to the axial reciprocation of the tubular string relative to the wireline configurable toolstring; and fluid flow out of the internal chamber of the wireline configurable toolstring in response to the axial reciprocation of the tubular string relative to the wireline configurable toolstring. The at least one of fluid flow into the internal chamber and fluid flow out of the internal chamber may impart rotary motion to an impeller of the wireline configurable toolstring, and the rotary motion of the impeller may at least indirectly impart rotary motion to an input of an alternator of the wireline configurable toolstring. The method may further comprise subjecting the impeller to fluid flowing between the wireline configurable toolstring and surface equipment via at least one of an internal passage of the tubular string and an annulus defined between a wall of the wellbore and the tubular string. The method may further comprise anchoring the wireline configurable toolstring within the wellbore by extending a feature of the wireline configurable toolstring into contact with the wellbore.

The present disclosure also introduces a method comprising conveying a wireline configurable toolstring within a wellbore extending into a subterranean formation via a tubular string to which the wireline configurable tool string is coupled, and rotating the tubular string relative to the wireline configurable toolstring within the wellbore, wherein the wireline configurable toolstring converts the tubular string rotation relative to the wireline configurable toolstring into electrical energy, and wherein the wireline configurable toolstring comprises at least one wireline configurable instrument powered by the electrical energy. The conveying and the rotating may be simultaneous. The wireline configurable instrument may be to obtain a fluid sample from the subterranean formation. The method may further comprise anchoring the wireline configurable toolstring within the wellbore by extending a feature of the wireline configurable toolstring into contact with the wellbore.

The present disclosure also introduces an apparatus comprising: a wireline configurable toolstring comprising: an interface to couple the wireline configurable toolstring with a tubular string in a manner permitting relative reciprocation of the wireline configurable toolstring and the tubular string, wherein the wireline configurable toolstring is conveyable within a wellbore extending into a subterranean formation via the tubular string; a converter of fluid flow resulting from relative reciprocation of the wireline configurable toolstring and the tubular string into electrical energy; and a wireline configurable instrument powered by electrical energy received from the converter. The wireline configurable instrument may be to measure a characteristic of the subterranean formation, wherein the characteristic may comprise at least one of an electrical property, a sonic property, a nuclear property and a physical property. The wireline configurable instrument may be to obtain a fluid sample from the subterranean formation. The tubular string may comprise a drillstring. The fluid flow resulting from relative reciprocation of the wireline configurable toolstring and the tubular string may comprise at least one of: fluid flow into an internal chamber of the wireline configurable toolstring; and fluid flow out of the internal chamber. The converter may comprise an impeller and an alternator, and the at least one of fluid flow into the internal chamber and fluid flow out of the internal chamber may impart rotary motion to the impeller. The rotary motion of the impeller may at least indirectly impart rotary motion to an input of the alternator. Rotary motion may also be imparted to the impeller by fluid flowing between the wireline configurable toolstring and surface equipment via at least one of an internal passage of the tubular string and an annulus defined between a wall of the wellbore and the tubular string. The impeller may be a mono-directional impeller, such that one of fluid flow into the internal chamber and fluid flow out of the internal chamber may impart rotary motion to the impeller but the other of fluid flow into the internal chamber and fluid flow out of the internal chamber may not impart rotary motion to the impeller. The converter may comprise an impeller, an alternator, and a gearing between the impeller and the alternator, and the at least one of fluid flow into the internal chamber and fluid flow out of the internal chamber may impart rotary motion to the impeller. The rotary motion of the impeller may at least indirectly impart rotary motion to an input of the gearing, and the rotary motion of the input of the gearing may indirectly impart rotary motion to an output of the gearing. The rotary motion of the output of the gearing may at least indirectly impart rotary motion to an input of the alternator. The wireline configurable toolstring may further comprise an extendable feature to extend from the wireline configurable toolstring into contact with a wall of the wellbore. The wireline configurable toolstring may further comprise a power sub, and the wireline configurable instrument may also be powered by electrical energy received from the power sub.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same aspects of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

conveying a wireline configurable toolstring within a wellbore extending into a subterranean formation via a tubular string to which the wireline configurable tool string is coupled in a manner permitting relative reciprocation of the wireline configurable toolstring and the tubular string;

anchoring the wireline configurable toolstring within the wellbore;

reciprocating the tubular string relative to the wireline configurable toolstring within the wellbore while the wireline configurable toolstring is anchored within the wellbore; and powering at least one wireline configurable instrument with electrical energy produced by converting fluid flow resulting from the tubular string reciprocation into the electrical energy, wherein the fluid flow comprises at least one of:

fluid flow into an internal chamber of the wireline configurable toolstring in response to the axial reciprocation of the tubular string relative to the wireline configurable toolstring; or fluid flow out of the internal chamber of the wireline configurable toolstring in response to the axial reciprocation of the tubular string relative to the wireline configurable toolstring; and the at least one of fluid flow into the internal chamber and fluid flow out of the internal chamber imparts rotary motion to an impeller of the wireline configurable toolstring, and wherein the rotary motion of the impeller at least indirectly imparts rotary motion to an input of an alternator of the wireline configurable toolstring.

2. The method of claim 1 comprising measuring a characteristic of the subterranean formation with the wireline configurable instrument during the anchoring and the reciprocating.

3. The method of claim 1 further comprising subjecting the impeller to fluid flowing between the wireline configurable toolstring and surface equipment via at least one of:

an internal passage of the tubular string; and an annulus defined between a wall of the wellbore and the tubular string.

4. The method of claim 1 wherein anchoring the wireline configurable toolstring within the wellbore comprises extending a feature of the wireline configurable toolstring into contact with a wall of the wellbore.

5. The method of claim 1 wherein the tubular string comprises a drill string.

6. The method of claim 1 wherein the tubular string comprises a wired drill pipe.

7. The method of claim 1 wherein anchoring the wireline configurable toolstring within the wellbore comprises extending a probe and backup pistons to contact a wall of the wellbore.

8. The method of claim 1 wherein anchoring the wireline configurable toolstring within the wellbore comprises inflating an expandable packer to contact a wall of the wellbore.

9. The method of claim 1 wherein anchoring the wireline configurable toolstring within the wellbore comprises extending a plurality of arms to contact a wall of the wellbore.

10. The method of claim 1 wherein reciprocating the tubular string relative to the wireline configurable toolstring comprises raising and lowering a drilling rig traveling block coupled to the tubular string.

11. The method of claim 1 wherein reciprocating the tubular string relative to the wireline configurable toolstring comprises holding a floating drilling rig traveling block stationary relative to a floating drilling rig.

* * * * *